US008165713B2

(12) United States Patent
Alberts et al.

(10) Patent No.: US 8,165,713 B2
(45) Date of Patent: Apr. 24, 2012

(54) CNC ABRASIVE FLUID-JET MILLING

(75) Inventors: Daniel G. Alberts, Renton, WA (US); Nicholas Cooksey, Seattle, WA (US); Thomas J. Butler, Enumclaw, WA (US); Peter J. Miles, Graham, WA (US)

(73) Assignee: Ormond, LLC, Auburn, WA (US)

( * ) Notice: Subject to any disclaimer, the term of this patent is extended or adjusted under 35 U.S.C. 154(b) by 916 days.

(21) Appl. No.: 12/193,414

(22) Filed: Aug. 18, 2008

(65) Prior Publication Data

US 2009/0124169 A1 May 14, 2009

Related U.S. Application Data

(63) Continuation of application No. 10/927,464, filed on Aug. 26, 2004, now Pat. No. 7,419,418.

(60) Provisional application No. 60/497,800, filed on Aug. 26, 2003, provisional application No. 60/552,314, filed on Mar. 10, 2004, provisional application No. 60/552,090, filed on Mar. 10, 2004.

(51) Int. Cl.
*G06F 19/00* (2006.01)
*B24B 49/00* (2006.01)

(52) U.S. Cl. ..... 700/188; 700/192; 451/5

(58) Field of Classification Search ..... 700/186–188, 700/192, 193; 451/2, 3, 5, 11
See application file for complete search history.

(56) References Cited

U.S. PATENT DOCUMENTS

| | | | | |
|---|---|---|---|---|
| 3,688,511 | A * | 9/1972 | Harmstrof et al. | 405/159 |
| 4,172,974 | A | 10/1979 | Budliger et al. | |
| 5,117,366 | A | 5/1992 | Stong | |
| 5,293,557 | A * | 3/1994 | Fujinaga et al. | 703/9 |
| 5,584,016 | A | 12/1996 | Varghese et al. | |
| 5,704,824 | A | 1/1998 | Hashish et al. | |
| 6,358,120 | B1 | 3/2002 | Poling et al. | |
| 6,385,499 | B1 | 5/2002 | Mattke et al. | |
| 6,981,906 | B2 | 1/2006 | Hashish et al. | |
| 2002/0032498 | A1 | 3/2002 | Mattke et al. | |
| 2003/0065424 | A1 | 4/2003 | Erichsen et al. | |
| 2003/0120375 | A1 * | 6/2003 | Arai et al. | 700/187 |
| 2003/0208296 | A1 * | 11/2003 | Brisson et al. | 700/117 |

* cited by examiner

*Primary Examiner* — Sean Shechtman
(74) *Attorney, Agent, or Firm* — Davis Wright Tremaine LLP; George C. Rondeau, Jr.

(57) ABSTRACT

A method and apparatus for milling a desired pocket in a solid workpiece uses an abrasive fluid-jet by moving and suitably orienting the abrasive fluid-jet relative to the workpiece. The method includes defining a path of the abrasive fluid-jet necessary to mill a desired pocket in the solid workpiece. The path is defined by a number of parameters. The parameters include a translation velocity, a fluid pressure, and an abrasive fluid-jet position and orientation relative to the workpiece. Generating a command set is according to the defined path and is configured to drive a computer numerical control manipulator system.

24 Claims, 16 Drawing Sheets

CNC ABRASIVE FLUID-JET MILLING

CROSS REFERENCE TO RELATED APPLICATIONS

Figure 1A:
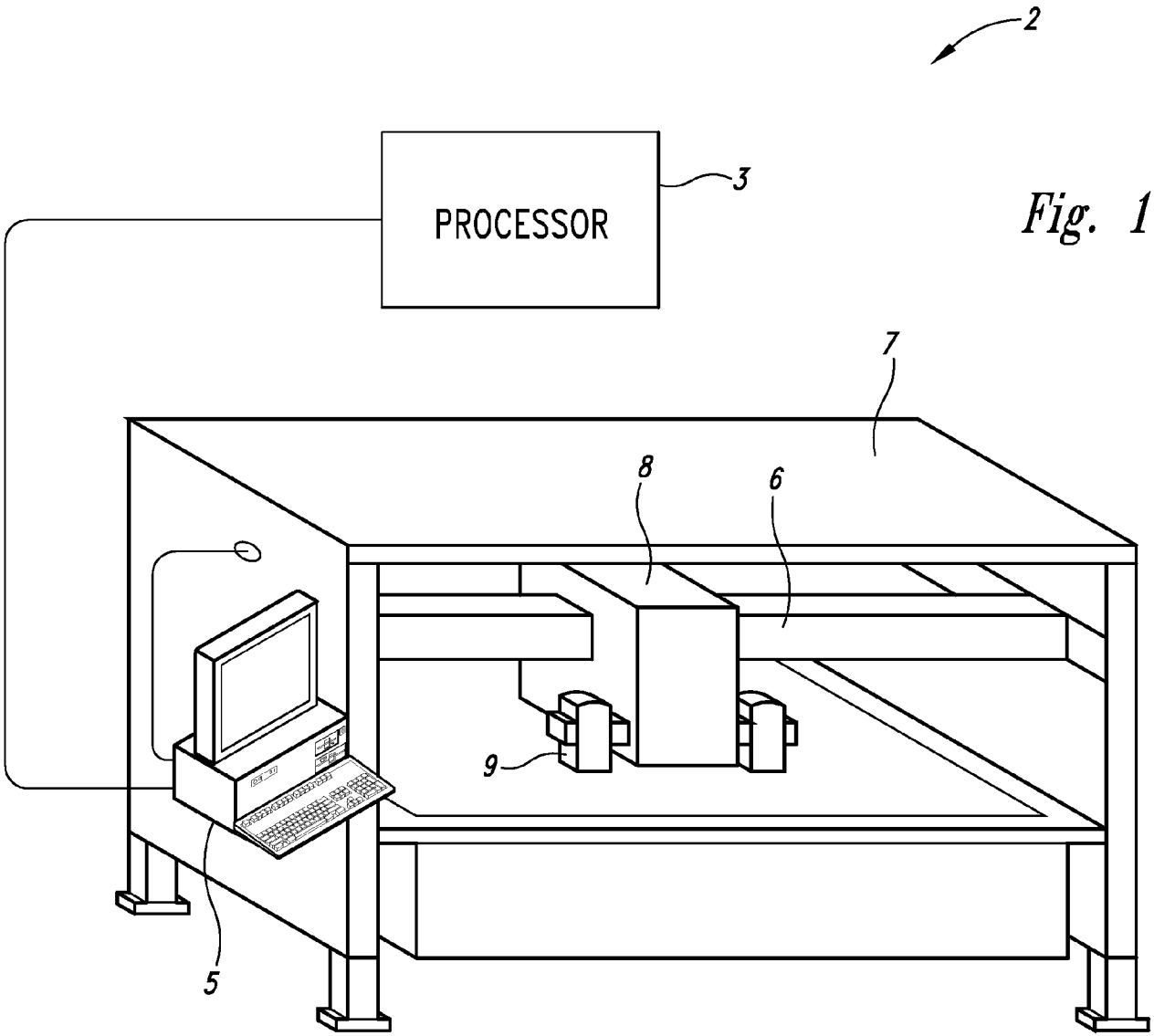

This application claims priority to U.S. patent application Ser. No. 10/927,464, entitled CNC ABRASIVE FLUID-JET MILLING, filed Aug. 26, 2004, and to the following three provisional applications filed by inventors Alberts et al., the first entitled METHOD AND APPARATUS FOR MACHINING CONTROLLED DEPTH PATTERNS, having Ser. No. 60/497,800 and filed on Aug. 26, 2003; the second, METHOD AND APPARATUS FOR MACHINING FLUID PASSAGES IN ROCKET ENGINE COMPONENTS, having Ser. No. 60/552,314 and filed on Mar. 10, 2004; and the third, METHOD AND APPARATUS FOR MACHINING FLUID PASSAGES IN RAMJET ENGINE COMPONENTS, having Ser. No. 60/552,090, and filed on Mar. 10, 2004. This application incorporates by reference as if fully contained herein each of the non-provisional and provisional applications recited.

BACKGROUND OF THE INVENTION

Field of the Invention

This invention relates generally to abrasive fluid-jet milling and, more specifically, to computer numerically controlled or CNC abrasive fluid-jet milling.

The water-jet has been used primarily as a cutting tool for non-contact cutting of many soft materials that cannot be advantageously cut by sawing techniques. The process uses one or more pumps that pressurize water to a high pressure, typically about 50,000-60,000 PSI, and pass the water through a small orifice, on the order of 0.002-to-0.020 inch diameter, in a nozzle to produce a high velocity water-jet. In the 1980s, the water-jet was improved by the introduction of abrasive fluid-jet cutting, wherein abrasive particles such as garnet are inducted into a mixing chamber and accelerated by the water-jet as they pass through a mixing tube. The addition of abrasive particles greatly improved the cutting speed and range of materials amenable to fluid-jet cutting.

Qualities of machining by abrasive fluid-jet, traditionally, have limited the use of the abrasive fluid-jet strictly to through-cutting, where the cutting jet passes all the way through the workpiece similar to a bandsaw. A cut produced by a jet, such as an abrasive fluid-jet, has characteristics that differ from cuts produced by more traditional machining processes. Unlike a hard cutter tool such as an end mill, the removal of material by abrading with the high-pressure fluid-jet has been very difficult to predict or control to the point where a desired finite depth pocket pattern could be obtained, and repeatable results were not achievable. Additionally, there has been little ability to achieve varied depth and shape of the pocket resulting from the abrading in order to meet engineering requirements of the workpiece. These operating characteristics have caused many to limit the use of the abrasive fluid-jet to applications to through-cutting. In through-cutting, the abrasive fluid-jet may simply be applied for a duration sufficient to breach the material and thus the control of the shape or depth of the pocket abraded in the material is less relevant to the result.

Where used for milling, the abrasive fluid-jet has been confined to masked use because of difficulties related to depth and pattern control. Such milling is generally in accord with the teaching of U.S. Pat. No. 5,704,824 to Hashish, et al. The Hashish method and apparatus for milling objects includes holding and producing high-speed relative motion in three dimensions between a workpiece and an abrasive fluid-jet. Affixing the workpiece to a rapidly rotating turntable spinning past an abrasive fluid-jet that moves radially with respect to the turntable creates the high-speed relative motion.

The method relies on the use of a wear-resistant mask for facilitating milling and production. The masks selectively shield the workpiece from the efficient milling by the abrasive fluid-jet. Such milling, however, limits the resulting profile of pockets milled in the workpiece. Masks are also expensive to make and inherently limit the geometries that may be milled. The milling is generally only useful for producing pockets of uniform depth because of the generally constant relative speed and the generally constant operation pressure commonly used.

The most common masking procedure is to place the workpiece on a turntable and spin the workpiece in the presence of a relatively stationary vertically-oriented abrasive fluid-jet. The abrasive fluid-jet is moved radially to the turntable to translate the abrasive fluid-jet across the surface of the workpiece. Because of a shuttering effect as the fluid-jet transitions from the mask to the workplace and the constant speed of the jet relative to the workpiece, pocket edges tend to be rounded with an arcuate profile at an intersection between a sidewall and the floor of the pocket. Additionally, the abrasive fluid-jet tends, as well, to undercut the workpiece at the mask interface. While the degree of rounding and undercutting is dependent upon the pressure of the abrasive fluid-jet flow and the relative speed between the workpiece and the fluid-jet, the rounding and undercutting is pronounced enough to confine the use of abrasive fluid-jet milling to relatively low precision milling and it can be used to address only a limited range of workpiece designs.

What is needed is a method and apparatus to exploit the abrasive fluid-jet for precision milling without relying on a mask or high-speed relative motion.

BRIEF SUMMARY OF THE INVENTION

The present invention includes a method and apparatus for milling a desired pocket in a solid workpiece by an abrasive fluid-jet by moving and suitably orienting the abrasive fluid-jet relative to the workpiece. The method includes defining a path of the abrasive fluid-jet necessary to mill a desired pocket in the solid workpiece. The path is defined by a number of parameters. The parameters include a translation velocity, a fluid pressure, and an abrasive fluid-jet position and orientation relative to the workpiece. Generating a command set is according to the defined path and is configured to drive a single-axis or multi-axis computer numerical control manipulator system.

The present invention comprises a system for removing pocket material, the pocket material being the material removed from the workpiece in order to define the desired pocket.

In accordance with further aspects of the invention, the abrasive fluid-jet milling pattern is a characteristic volume of the material removed in each unit of an exposure time. The abrasive fluid-jet milling pattern is determined at selected values for each of the relevant parameters. Such parameters include a fluid pressure, a selected abrasive flow rate, a selected mixing tube length, and a selected mixing tube alignment with the abrasive fluidjet and being expressed as a function of a polar angle from a nozzle of a mixing tube. By studying abrasive fluid-jet milling patterns resulting from the varying of each of the several parameters independently, a catalogue of abrasive fluid-jet milling patterns associated with each setting of the parameters is possible.

In accordance with other aspects of the invention, a computer selects the abrasive fluid-jet milling pattern from a plurality of abrasive fluid-jet milling patterns for removing the pocket material.

In accordance with still further aspects of the invention, the computer defines the desired pocket as a set of contiguous removed volume cells, the removed volume cells determined according to the abrasive fluid-jet milling pattern and a removed volume cell origin point corresponding to each removed volume cell. Advantageously, the computer also determines an exposure time necessary to remove the material in each removed volume cell.

In accordance with yet other aspects of the invention, includes ordering a set of the volume cell origin points to generate an ordered removed volume cell origin set wherein each element is a volume cell origin point and corresponds to one removed volume cell and includes the origin point, the abrasive fluid-jet milling pattern, the abrasive fluid-jet orientation, and the exposure time. Defining the path includes ordering a set of the volume cell origin points to generate an ordered removed volume cell origin set and wherein each element is a volume cell origin point and corresponds to one removed volume cell and includes the origin point, the abrasive fluid-jet milling pattern, the abrasive fluid-jet orientation, and the exposure time.

In accordance with still another aspect of the invention, where a computer numerically controlled, often termed CNC machine, is oriented in a planar fashion, the movement of the abrasive fluid-jet relative to the workpiece, the ordering of the set is first according to an x-coordinate in the volume cell origin points; and then the ordering volume cell origin points with the same x-coordinate according to a y-coordinate in the volume cell origin points.

In accordance with still further aspects of the invention, alternately, the sets may be ordered by first ordering the set according to an y-coordinate in the volume cell origin points; and then ordering volume cell origin points with the same y-coordinate according to a x-coordinate in the volume cell origin points.

In accordance with yet another aspect of the invention, ordering the set includes sorting volume cell origin points such that in the ordered set between any first volume cell origin point and any consecutive second volume cell origin point there is an absolute distance and the volume cell origin points are ordered to minimize the magnitude of the greatest absolute distance between every first volume cell and second volume cell.

In accordance with further aspects of the invention, includes segmenting the path into an ordered segment set, the ordered segment set including a milling segment for each volume cell origin point. The invention may advantageously include selecting a translational velocity for each segment the translational velocity being selected to allow translation through the milling segment in an interval equal to the exposure time of the volume cell origin point.

In accordance with still further aspects of the invention, ordered segment sets include transition segments, the transition segments situated between milling segments and configured to allow completion of movement from a first volume cell origin point to a second volume cell origin point and a change in abrasive fluid-jet orientation from the orientation of the first volume cell origin point to the second volume cell origin point.

In accordance with additional aspects of the invention, the workpiece is submerged in a fluid bath.

In accordance with yet other aspects of the invention, wherein a mixing tube nozzle is suitably enclosed with a vacuum shroud.

BRIEF DESCRIPTION OF THE SEVERAL VIEWS OF THE DRAWING(S)

The preferred and alternative embodiments of the present invention are described in detail below with reference to the following drawings.

Figure 1B:
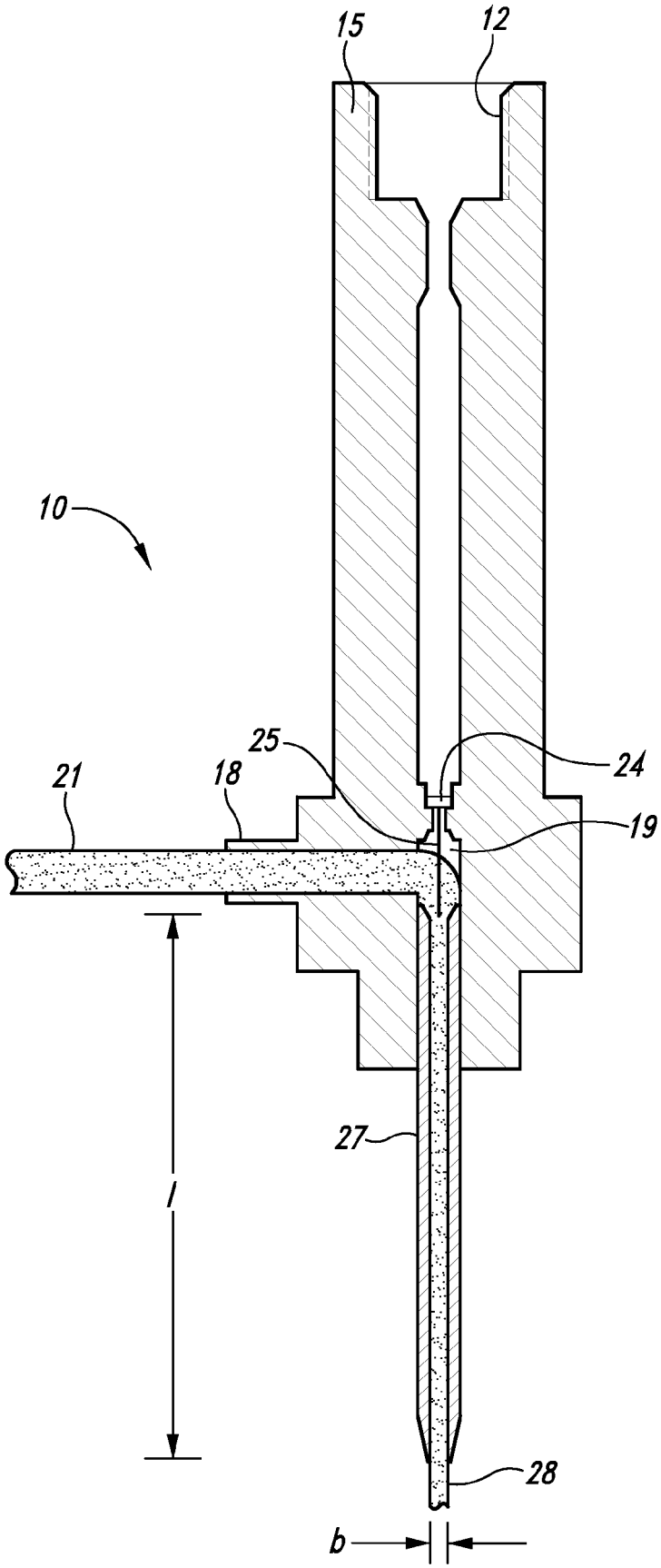
Figure 2:
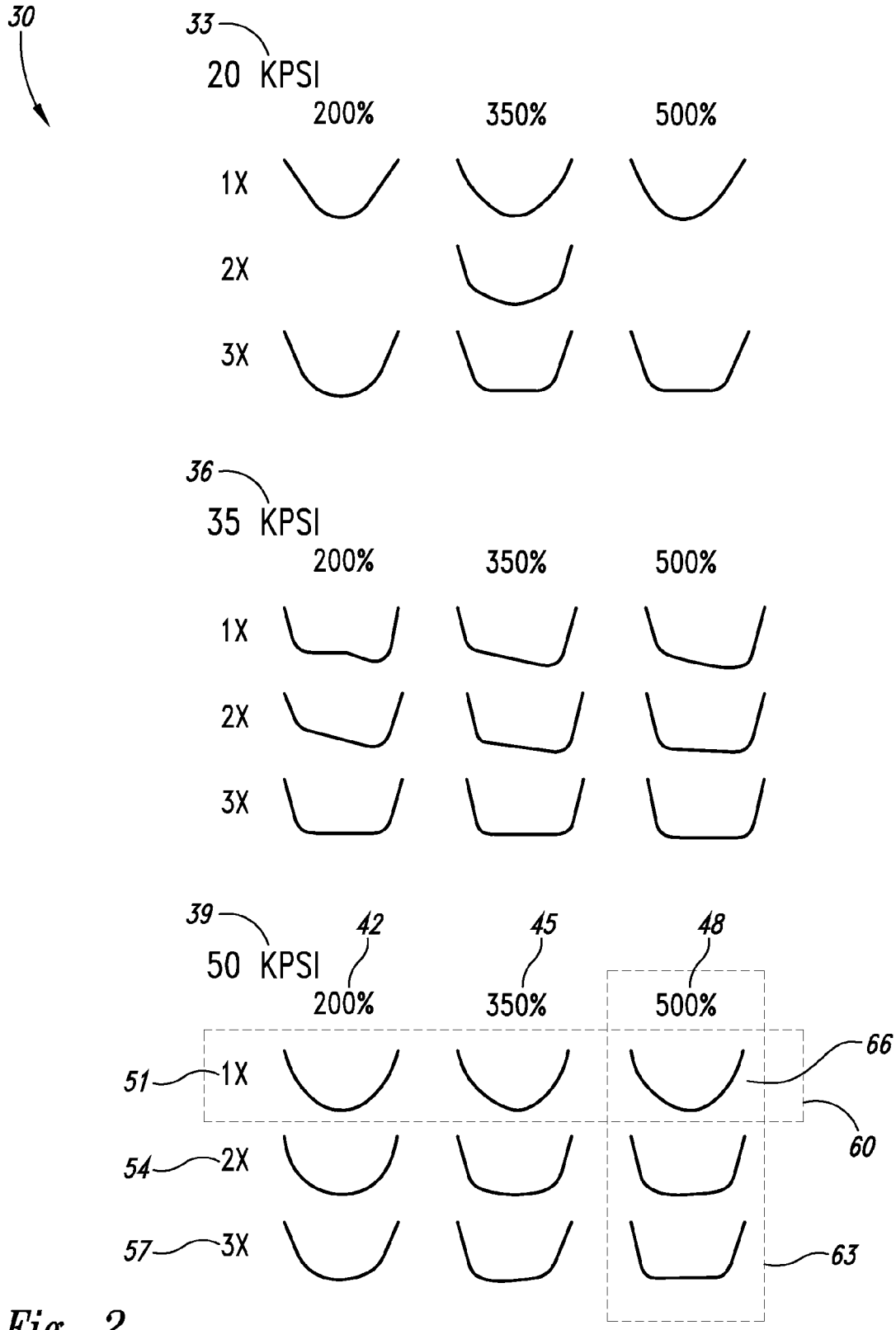
Figure 3A:
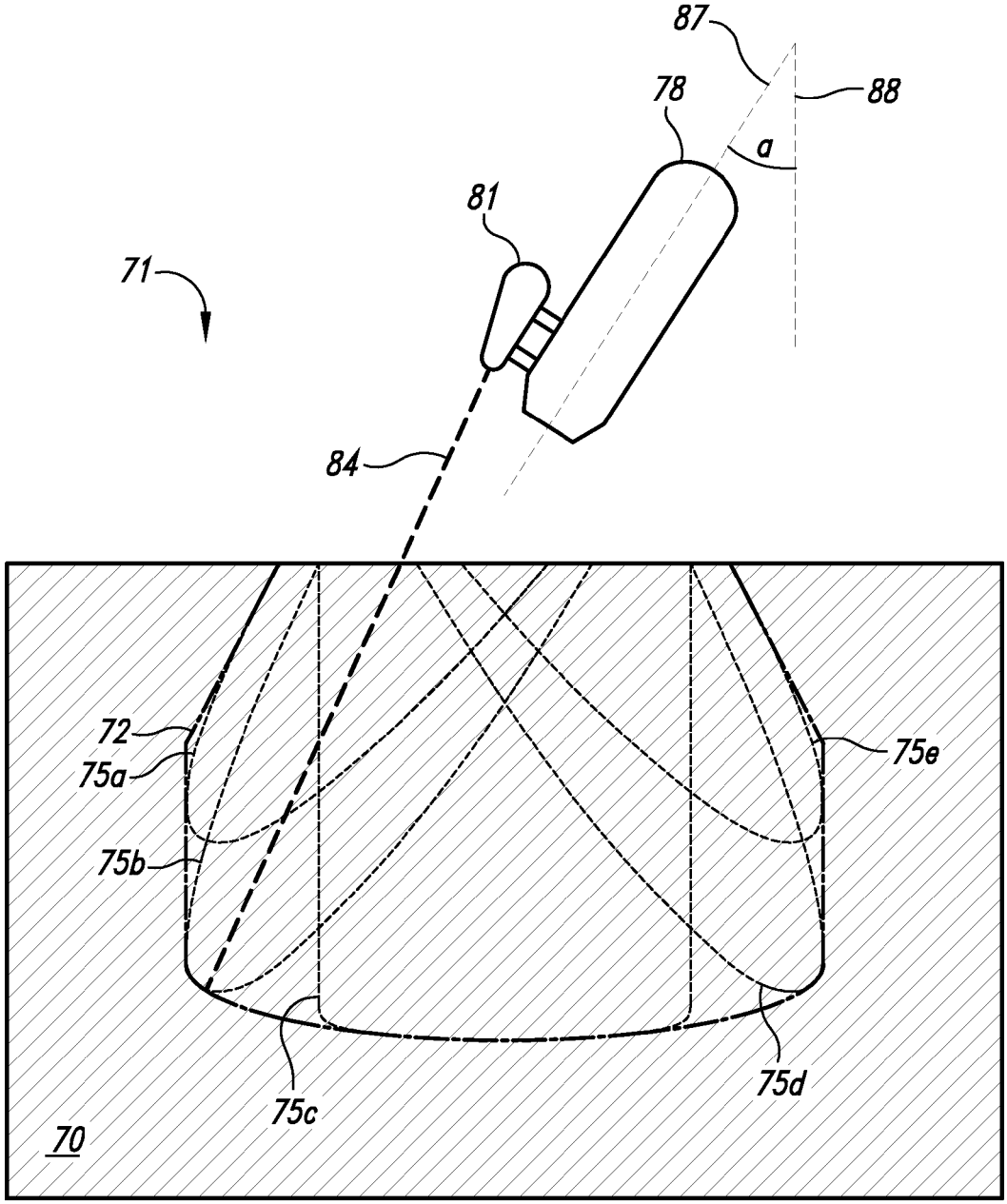
Figure 3B:
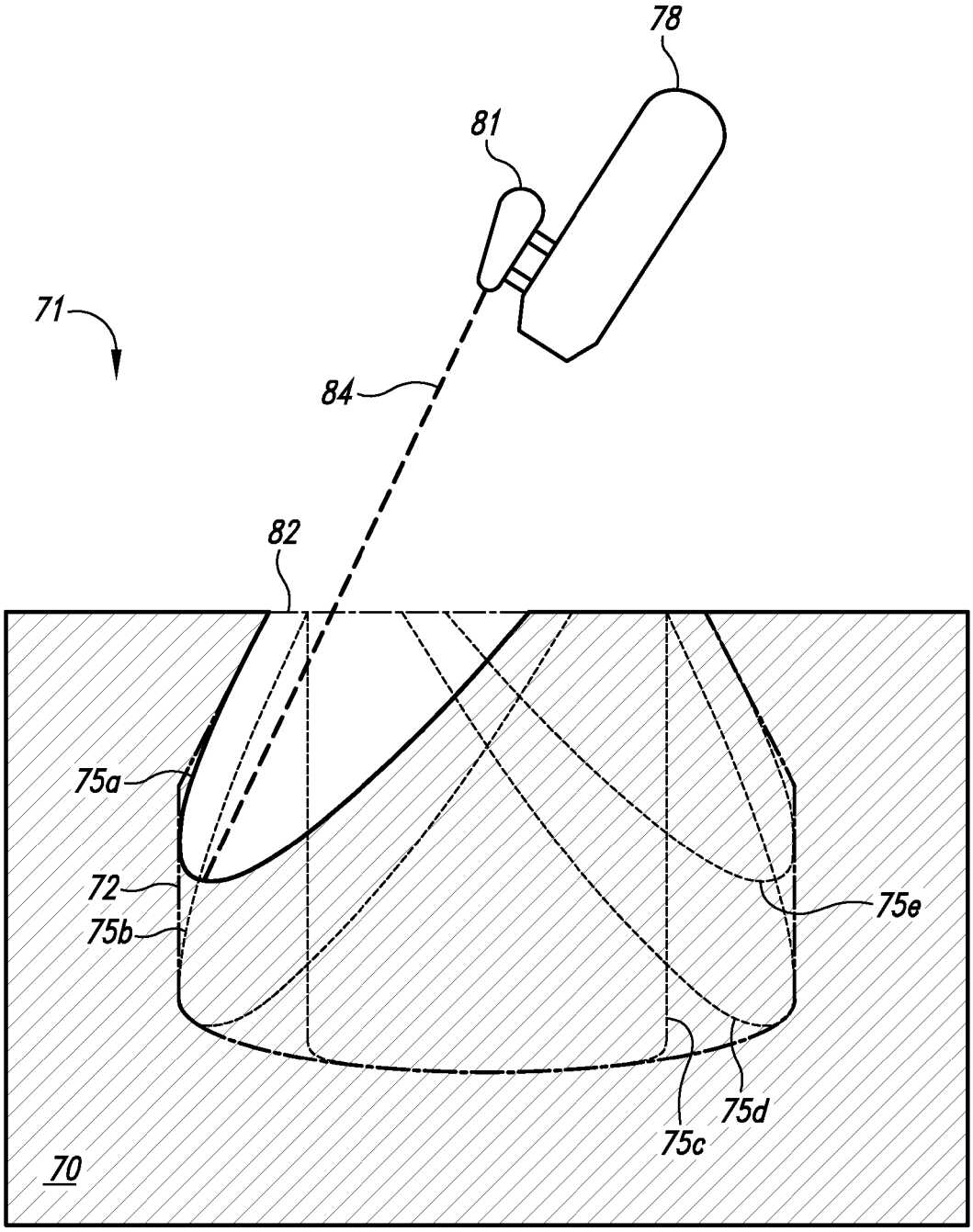
Figure 3C:
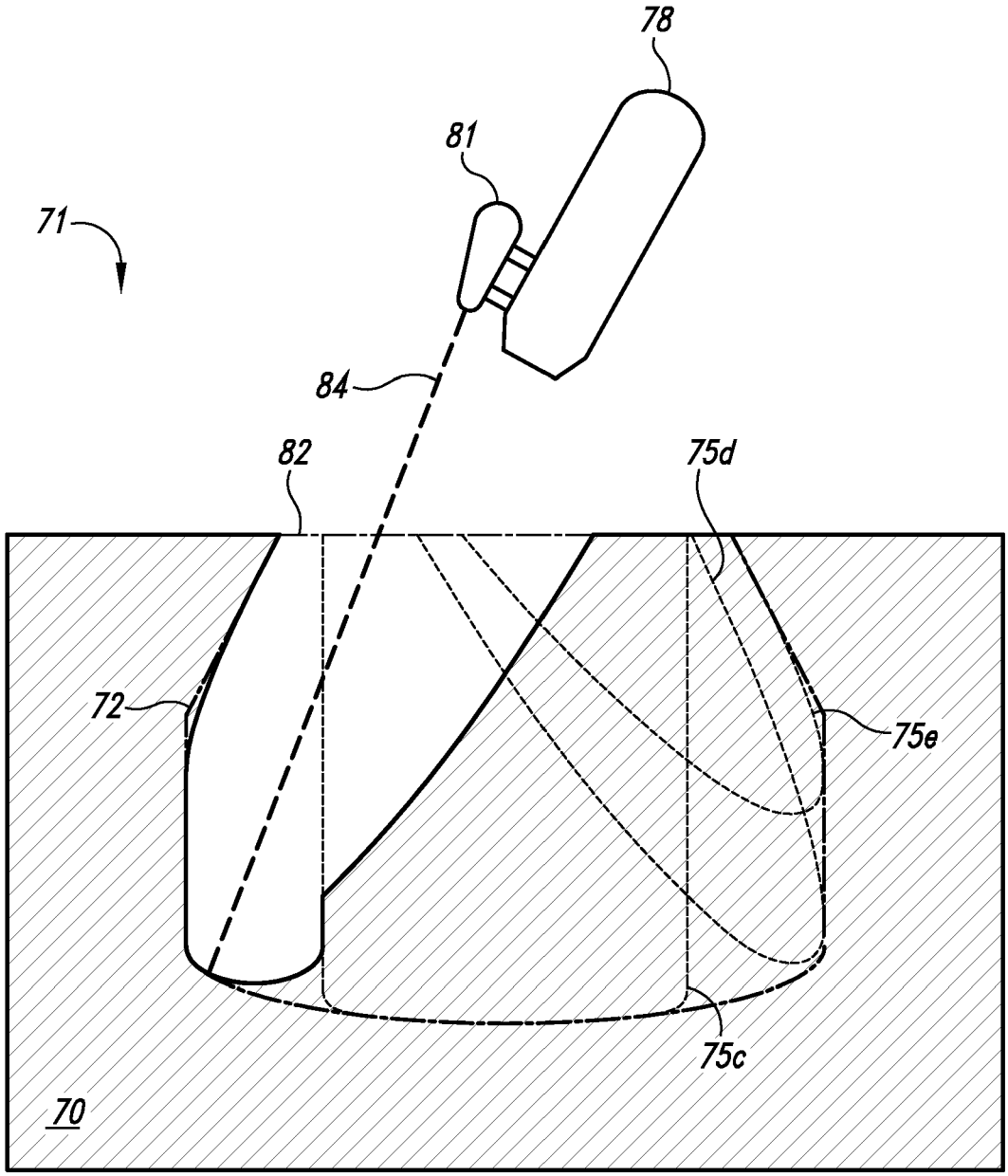
Figure 3D:
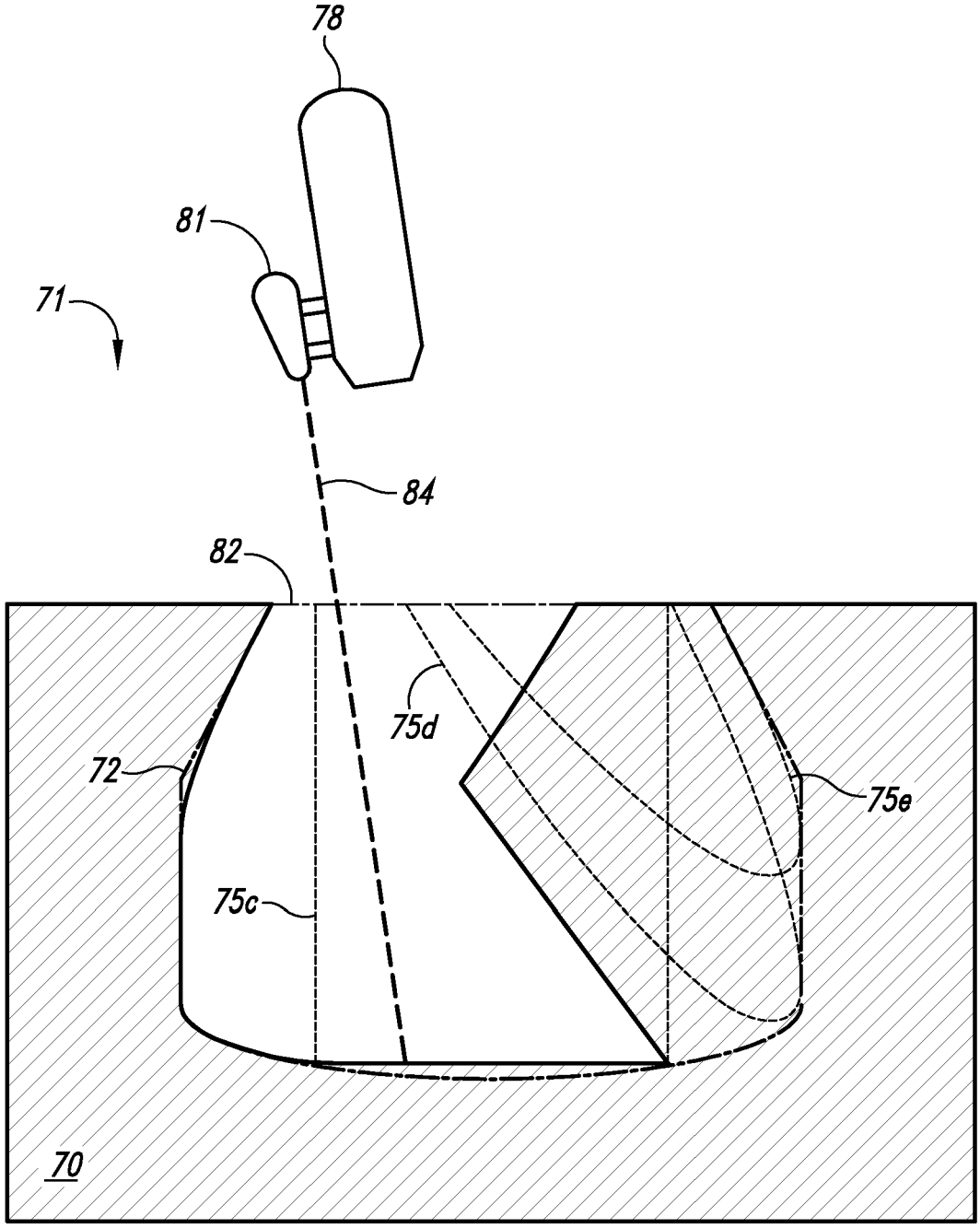
Figure 3E:
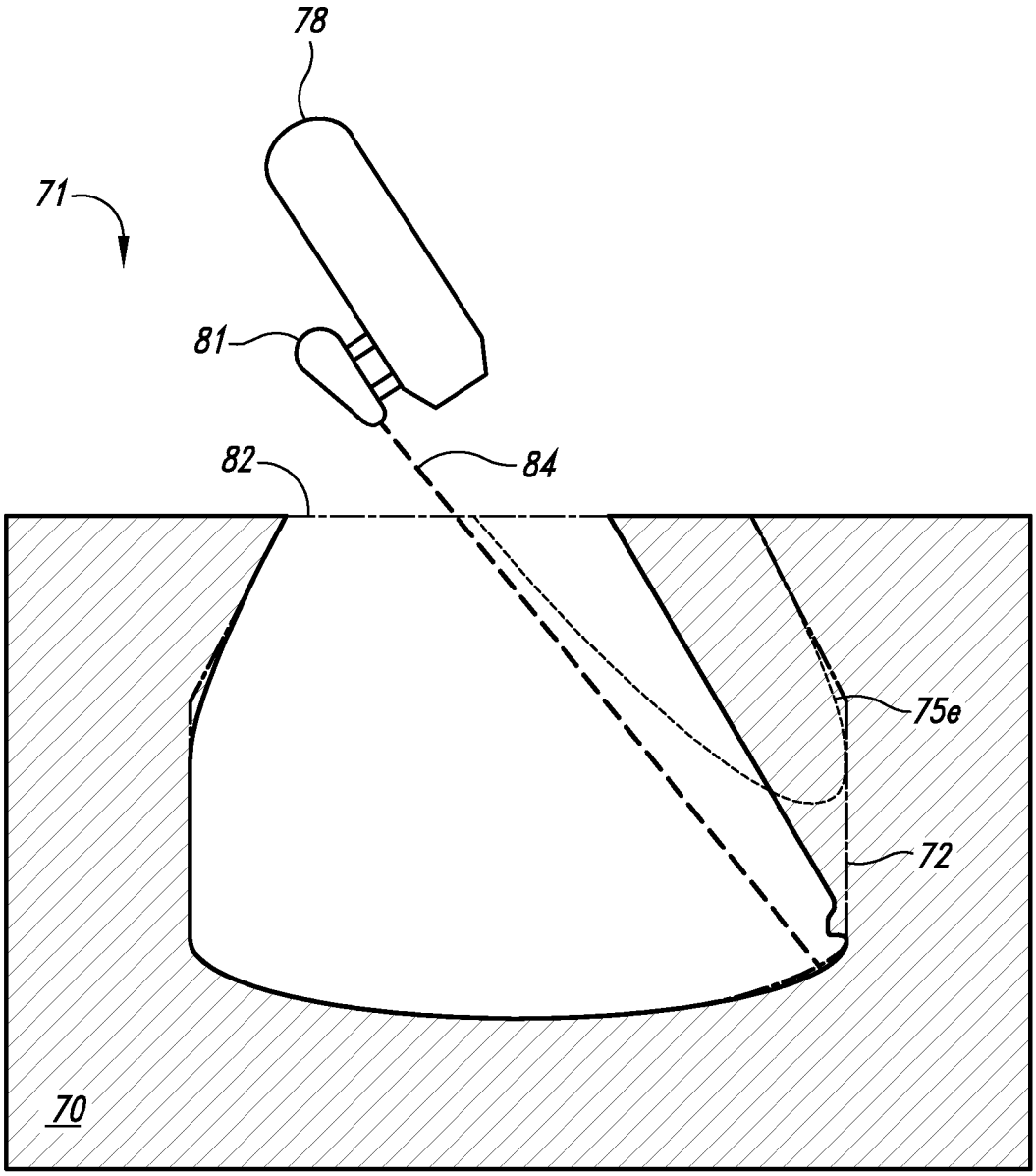
Figure 3F:
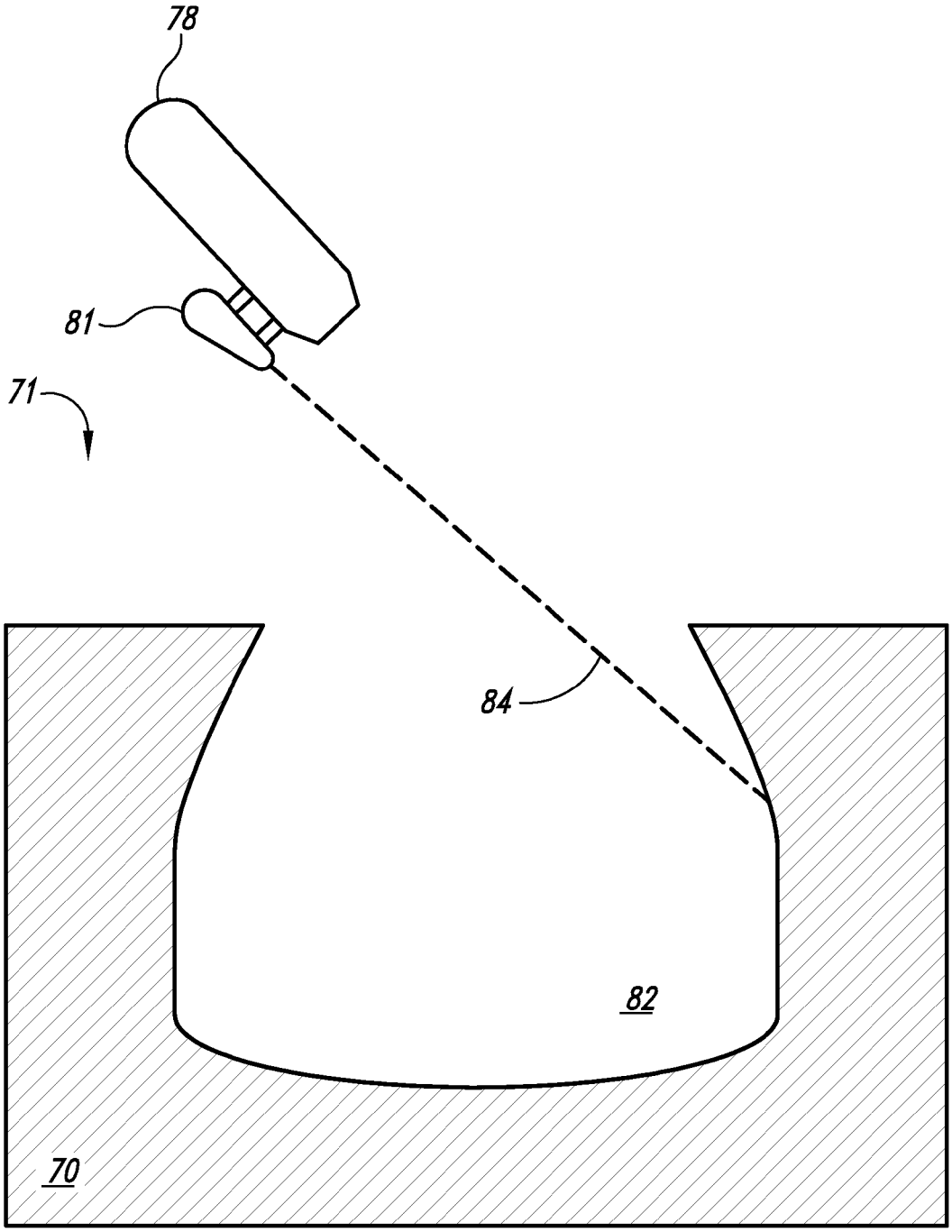
Figure 4:
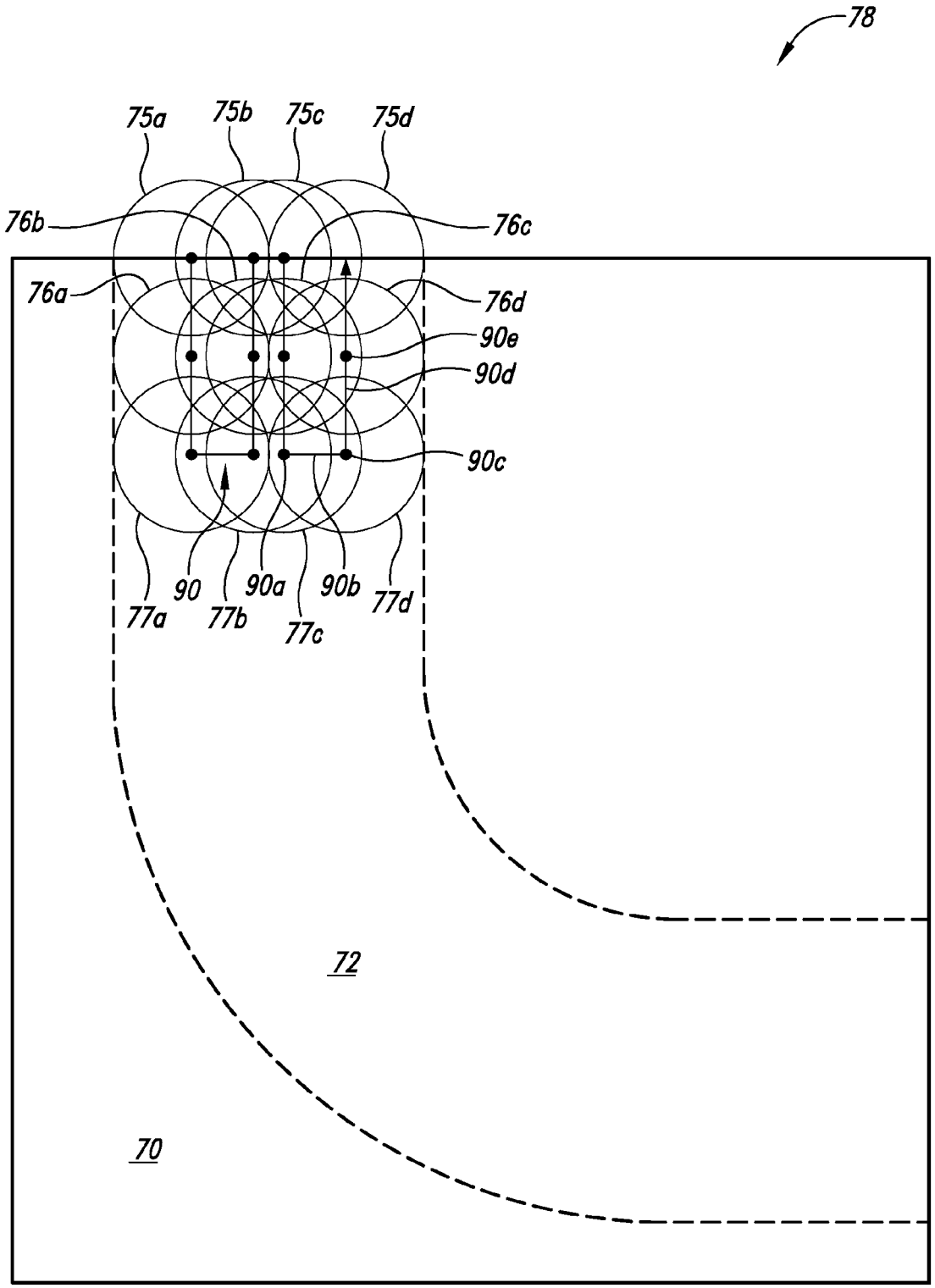
Figure 5A:
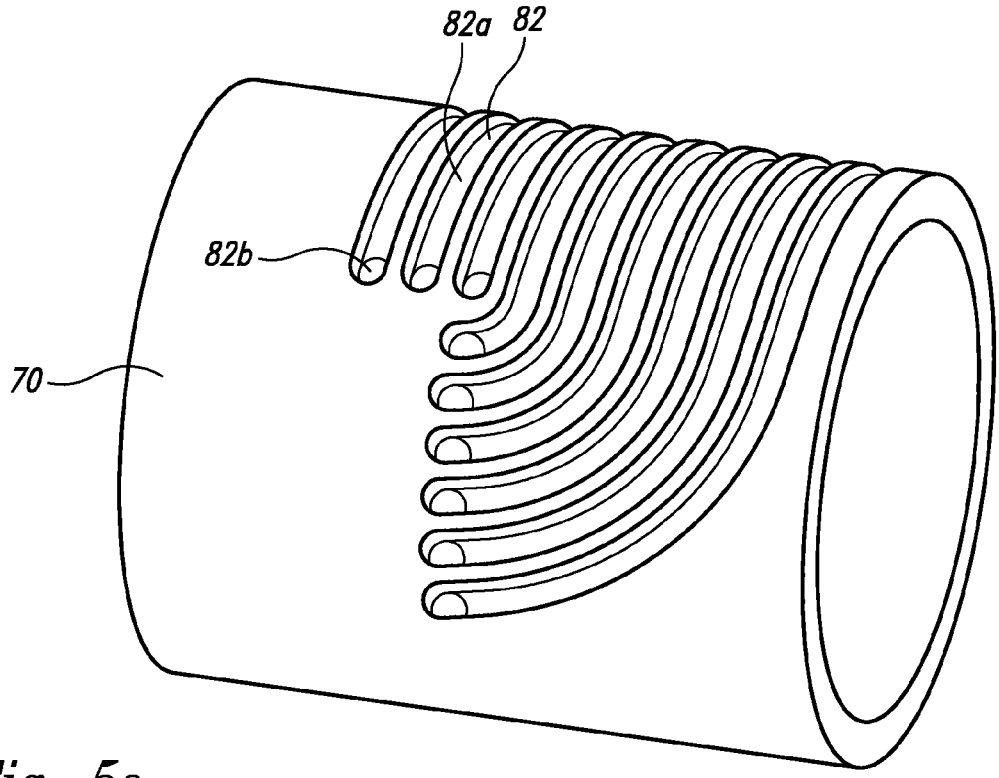
Figure 5B:
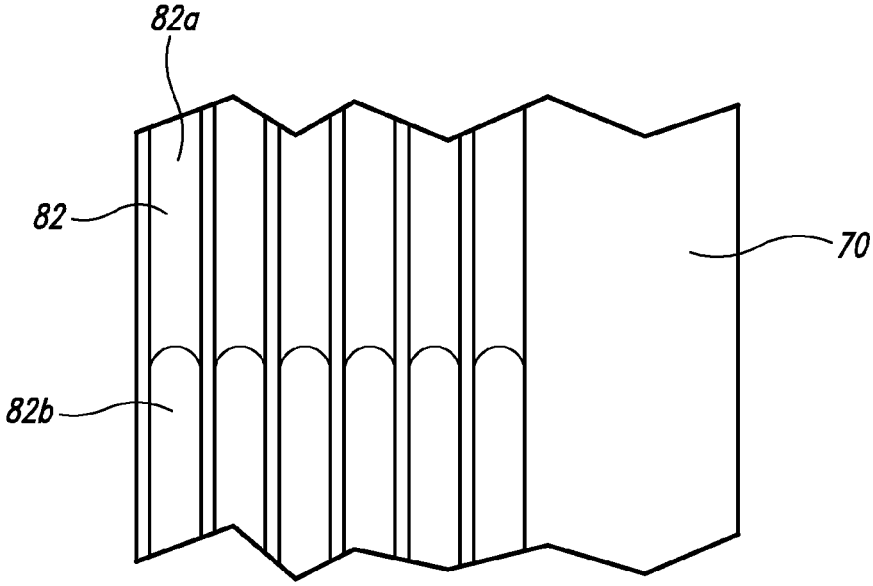
Figure 5C:
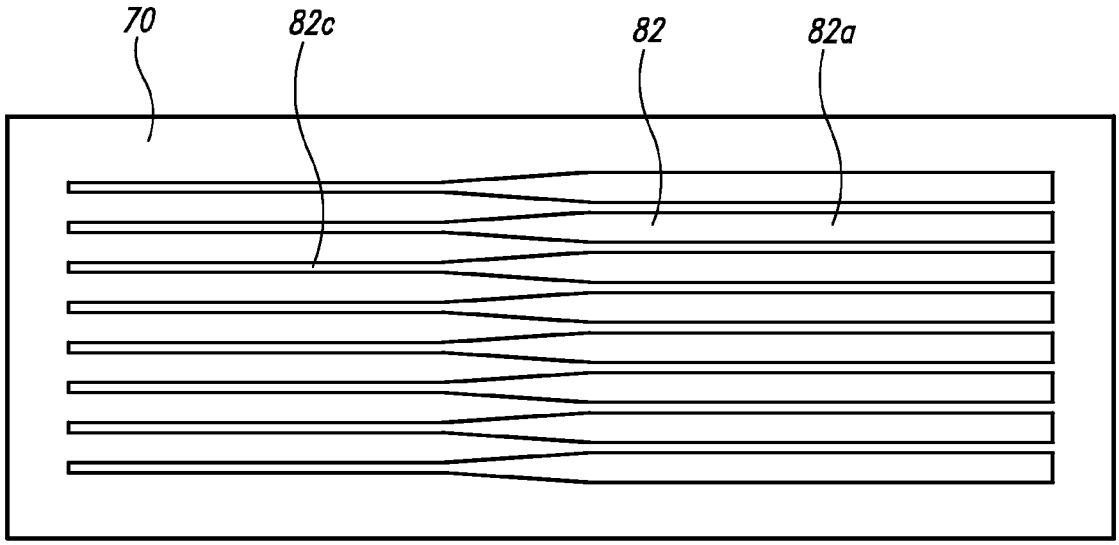
Figure 5D:
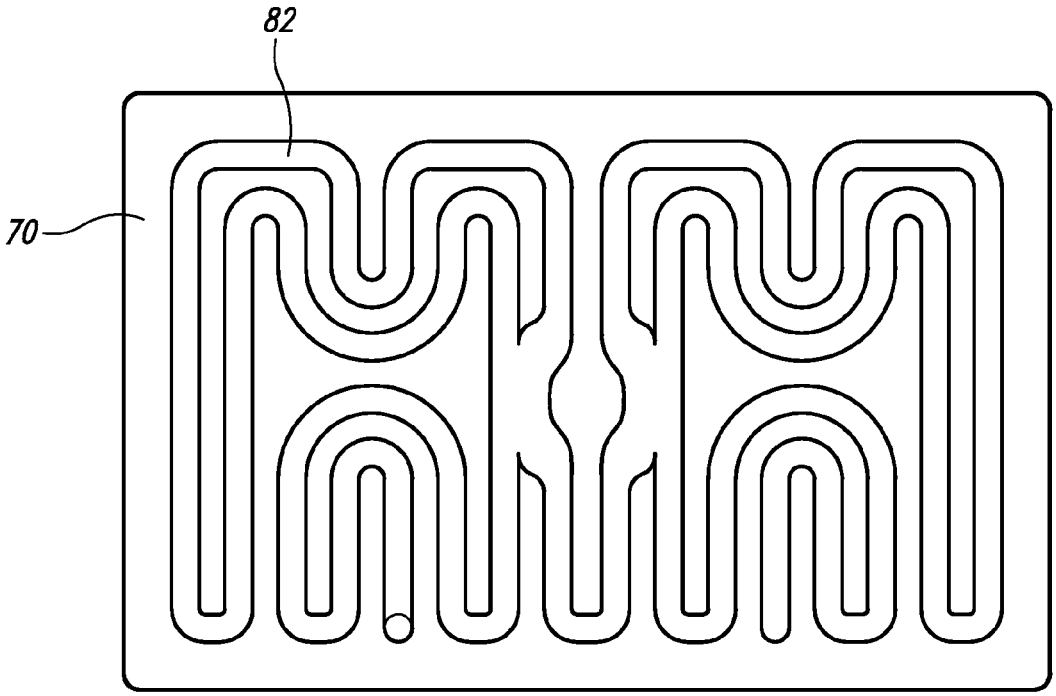
Figure 5E:
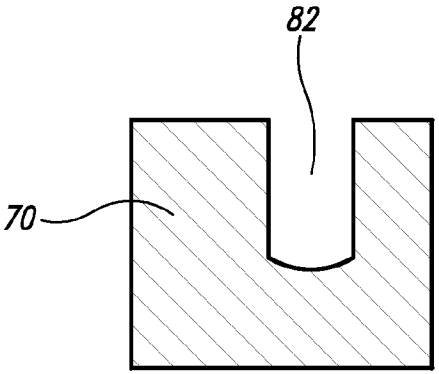
Figure 5F:
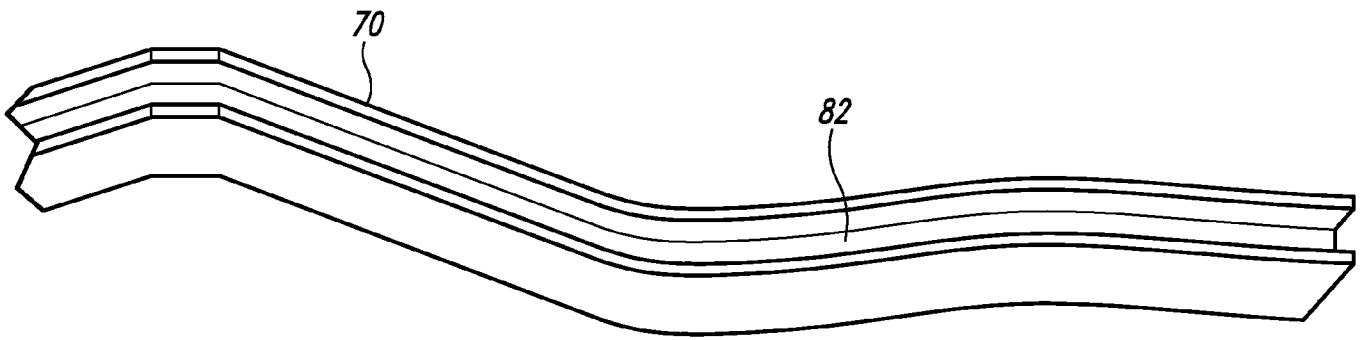
Figure 6A:
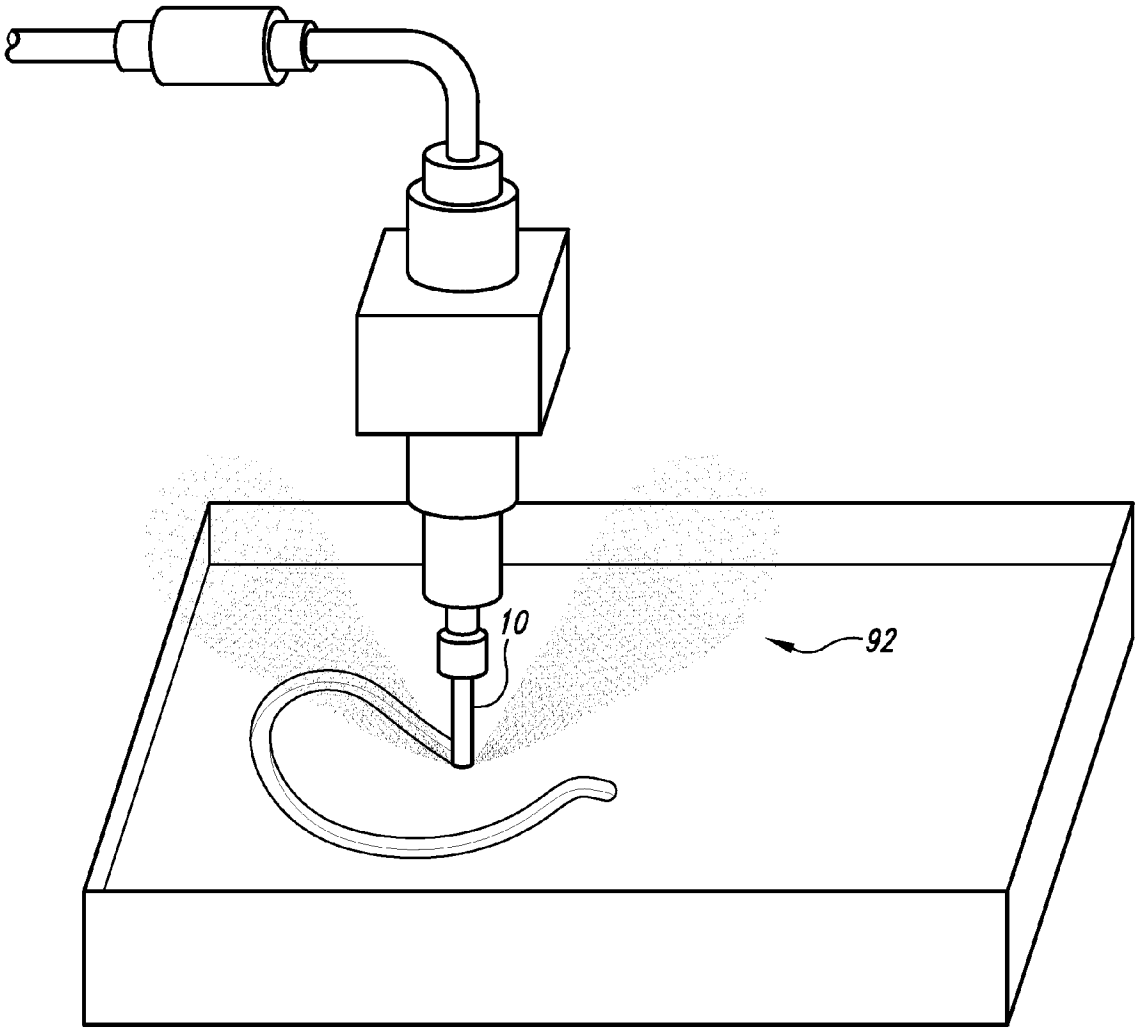
Figure 6B:
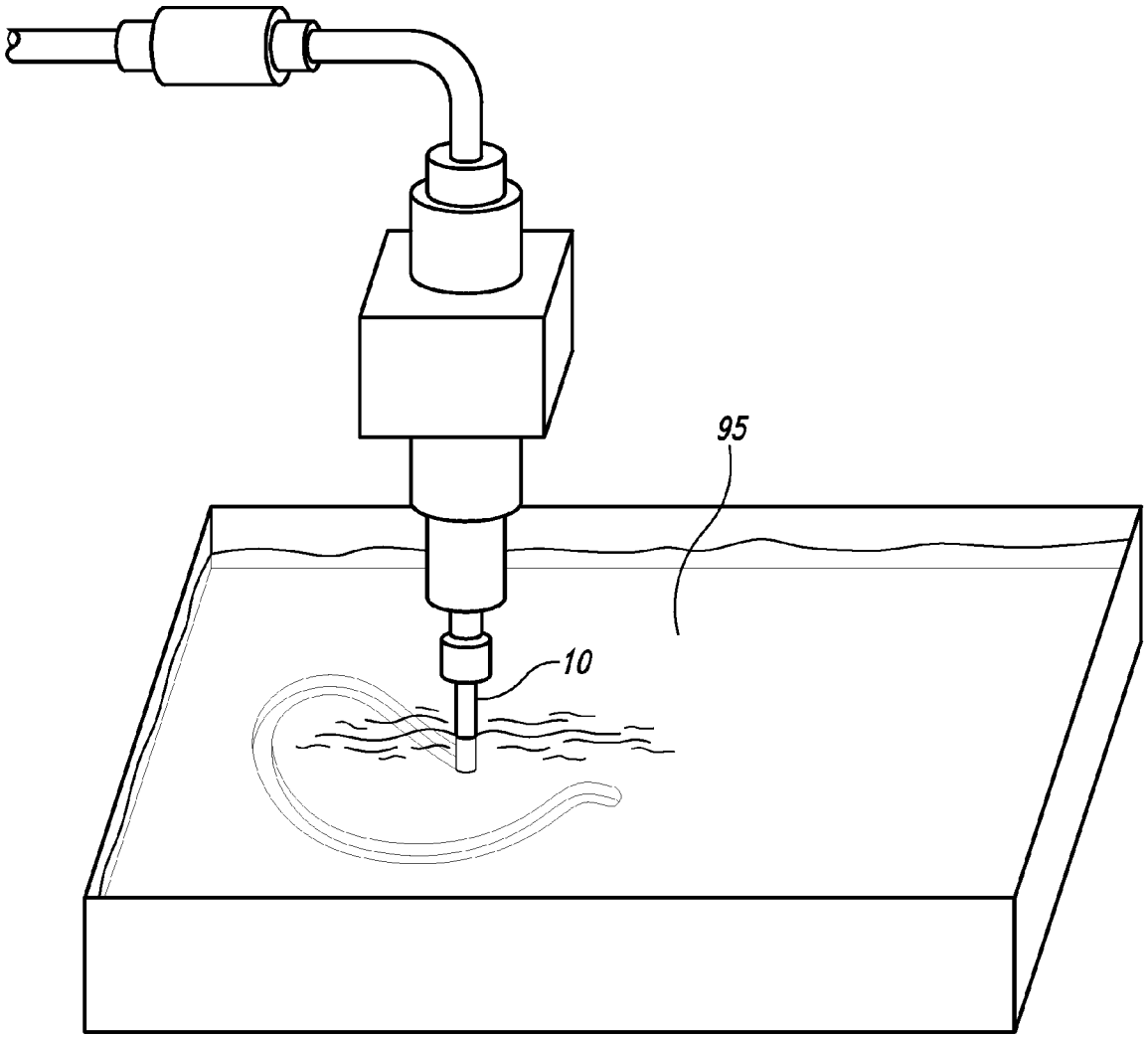
Figure 6C:
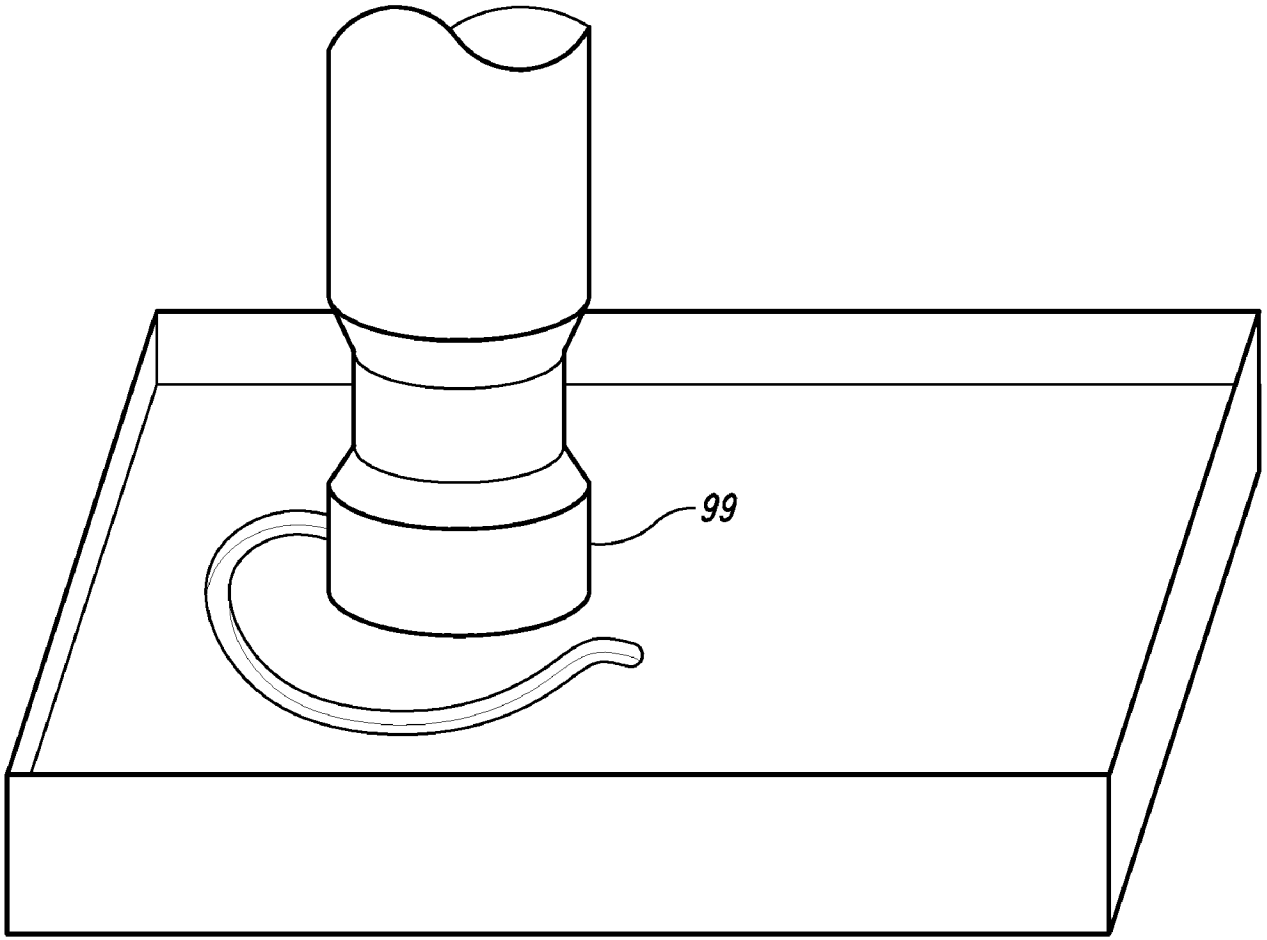

FIG. 1*a* is block diagram of an milling machine;

FIG. 1*b* is a cutaway diagram of an abrasive fluid-jet configured for milling;

FIG. 2 is a diagram of cutting profiles resulting from application of the abrasive fluid-jet at discrete settings;

FIG. 3*a* is a cross-section of a pocket for milling;

FIG. 3*b* is a cross-section of a pocket for milling showing a first void;

FIG. 3*c* is a cross-section of a pocket for milling showing a second void;

FIG. 3*d* is a cross-section of a pocket for milling showing a third void;

FIG. 3*e* is a cross-section of a pocket for milling showing a fourth void;

FIG. 3*f* is a cross-section of a pocket for milling showing a final void;

FIG. 4 is a plan view of pocket for milling and a path for milling;

FIG. 5*a* is a perspective view of a pocket cut in a cylindrical workpiece;

FIG. 5*b* is a perspective view of multi-depth pocket in a workpiece;

FIG. 5*c* is a perspective view of a multi-profile pocket in a workpiece;

FIG. 5*d* is plan view of a complex pocket in workpiece;

FIG. 5*e* is a cross-section of a pocket in a 3-dimensioned workpiece;

FIG. 5*f* is a perspective view of a pocket in the 3-dimensioned workpiece;

FIG. 6*a* is a side view of abrasive fluid-jet milling in ambient atmosphere;

FIG. 6*b* is a side view of abrasive fluid-jet milling in a submerging bath; and FIG. 6*c* is an overhead view of an air shroud for containment of abrasive fluid-jet spray.

DETAILED DESCRIPTION OF THE PREFERRED EMBODIMENT

By way of overview, a method for milling a desired pocket in a solid workpiece using an abrasive fluid-jet by moving and suitably orienting the abrasive fluid-jet relative to the workpiece includes defining a path of the abrasive fluid-jet necessary to mill a desired pocket in the solid workpiece. The path is defined as the relative motion between the workpiece and the abrasive fluid-jet as well as a number of parameters. The parameters are stored in an ordered set of volume cell origin points and include a translation velocity, a fluid pressure, and an abrasive fluid-jet position and orientation relative to the workpiece. A command set is generated and configured to drive a multi-axis computer numerical control manipulator system according to the defined path.

The term pocket describes any concavity to be milled into the surface of a workpiece. A channel is a specialized case of the more general term pocket. The pocket is any concavity defined in the workpiece as a resulting from the milling whereas a channel is generally a concavity that is elongated; commonly channels can be used as fluid conduits.

Referring to FIG. 1*a*, an abrasive fluid-jet milling apparatus 2 is controlled by instructions stored on a computer-readable medium (not separately shown), in the case of the presently preferred embodiment, stored in a memory in operative communication with a computer 3. The computer 3 includes the instructions derived by a process of studying a spray pattern of an abrasive fluid-jet and based upon an assumption that the amount of material that the spray pattern removes is a linear function extrapolation of the material removed in a unit time interval. Thus, according to the assumption, the amount and pattern of the removal of material removed in two unit time intervals will be approximately twice that removed in a single unit time interval. Small deviations from strict linearity are predicted and accommodated by correction factors.

The term abrasive fluid-jet is used rather than to limit the invention to the strict definition of a water-jet to also include such devices as use a fluid to accelerate an abrasive to a surface to be milled. Several examples of fluids that are suitably used to accelerate an abrasive include cryogenic liquids such as liquid nitrogen, gasses, oils, and fluorocarbon compounds. Thus, the term abrasive fluid-jet is selected to encompass any abrading tool in which a fluid accelerates an abrasive such as garnet to the surface of a workpiece for abrading material from that surface.

The computer 3 configures a series of ordered sets of volume cell origin points, the ordered set includes parameters such as an abrasive fluid-jet reference point relative to the workpiece, an abrasive fluid-jet orientation at that reference point, an abrasive fluid: jet pressure, and an exposure time for the abrasive fluid-jet. The instructions are configured to be communicated to a driver 5 for a conventional computer numeric controlled machine tool for manipulating a tool and a workpiece to generate controlled relative motion, in this case, to direct the abrasive fluid-jet according to the ordered set of origin points.

In the presently preferred embodiment, an x-motion motor 6 is configured for motion in an arbitrary orientation in a plane. A y-motion motor 7 is configured for motion in the plane but perpendicular to the motion generated by the x-motion motor 6, such that, acting in concert, the motors 6, 7, can fully describe the plane within a defined range of motion. An additional, z-motion motor 8 controls movement in an orientation perpendicular to the plane. A wrist mount 9 controls an angle of orientation of the abrasive fluid-jet from a point arrived at by appropriate activation of the x-motion, y-motion, and z-motion motors 6, 7, and 8, respectively. The driver 5 translates communicated instructions from the computer 3 to suitably activate the motors 6, 7, and 8, as well as the wrist mount 9 in order to suitably mill the workpiece.

A preferred embodiment of the invention drives an abrasive fluid-jet assembly 10, in the illustrated case, an abrasive waterjet nozzle assembly, to enable controlled depth machining. Suitably selecting a geometry of the abrasive fluid-jet assembly 10 enables selective formation of an abrasive fluid-jet abrasive fluid-jet milling pattern configured to optimally remove a volume of workpiece material. Feed water is fed by means of a conduit with a suitable fitting (not shown) connecting to an abrasive fluid-jet housing 15 at a threaded fitting receptacle 12 at a fluid-jet feed pressure, usually set at a discrete setting in the range of 10,000 to 100,000 PSI.

The abrasive fluid-jet housing is configured such that water fed into the receptacle 12 exits a jet orifice 24 as a coherent high velocity water-jet 25. The jet orifice 24 conducts the water-j et into a mixing chamber 19 defined in the housing 15. An abrasive material 21 is conducted in an abrasive conduit 18 into the mixing chamber 19, where the abrasive material 21 is entrained, according to the Bernoulli effect, in the water-jet 25 for exit from the housing 15 to perform the milling of the workpiece. Garnet, silica sand, plastic media, glass bead, iron shot, stainless steel shot or other abrasive media are used depending upon a desired surface finish and the selected workpiece material.

A mixing tube 27 is suitably aligned with the water-jet 25 as it leaves the orifice 24 to generate a selected and repeatable spray pattern. The mixing tube 27 forces a transfer of energy from the water-jet 25 to accelerate the entrained abrasive particles, while holding the accelerated particles in a narrow beam. The housing 15 is machined to precisely hold all components relative to one another, while facilitating easy component changes. A relationship between a diameter b of an interior bore of the mixing tube 27 to its bore length l uniquely and, again, repeatably determines the resulting spray pattern and the material correspondingly removed from the workpiece. Typically, the ratio of the length to the radius (½ of the diameter b) is between 60 and 500, but this disclosure is not limited to that range. Additionally, the numeric relationship between the diameter b of the interior bore of the mixing tube 27 to the diameter of the orifice 24 markedly changes the characteristic spray pattern of the abrasive fluid-jet assembly 10.

Referring to FIG. 2, the spray pattern and the corresponding removal of material are studied to give characteristic profiles. Where used herein, the abrasive fluid-jet milling pattern refers to the amount and pattern of material removed when the material is subjected to a particular spray pattern for a unit time interval. An exemplary catalog of abrasive fluid-jet milling patterns 30 includes tables of milling patterns at feed water pressures of 20,000 psi (table 33); 35,000 psi (table 36); and 50,000 psi (table 3). Taken as an exemplary table, the 50,000 psi table 39 indicates the abrasive fluid-jet milling patterns for amounts of material removed over a unit time interval at the nominal feed water pressure, in this case 50,000 psi, a given mixing tube alignment with the water-jet 25 (FIG. 1*b*) and varying the mixing tube length by units of the exemplary length, such as 1× unit 51, 2× units 54, and 3× units 57, and varying abrasive flow rates, such as 200% of the unit abrasive flow rate 42, 350% of the unit abrasive flow rate 45, and 500% of the unit abrasive flow rate 48.

While not entirely predictive of the abrasive fluid-jet milling pattern, a general trend is that increased abrasive flow and increased mixing tube length results in more square bottoms in a pocket milled into the material. Alternatively, reduced abrasive flow and reduced mixing tube length moves the shape towards a radius bottom and then to a V-shaped bottom of the pocket. The precise operating parameters to be used to generate a specific geometry in a given material type are often selected by making trial cuts before machining the work piece.

Studying the abrasive fluid-jet milling patterns for a particular workpiece material yields a catalog of tools for milling pockets. For instance, where a volume of the chosen material is to be removed to define a pocket of roughly u-shaped cross-section, the profile that most closely represents the desired cross-section profile is selected to be a cross-section with suitable depth 66. Reference to the catalogue shows the desired cross-section profile 66 to be a part of the 50,000 psi table 39. By noting the desired cross-section profile 66 is associated with the 500% abrasive feed rate as is indicated in the 500% column 60 and associated with a mixing tube length of a single unit as is indicated by its presence in the "1×" row. Thus, at the water feed pressure of 50,000 psi, at the given mixing tube alignment with the water-jet, an abrasive feed rate of 500% with a 1× mixing tube length l will yield the suitable abrasive fluid-jet milling pattern according to the desired cross-section profile 66. In the same manner, for any given volume and pattern of material to be removed to define a pocket, a suitable cross-section profile is chosen to remove the material.

Referring, to FIG. 3*a*, a suitable overlay 71 of volume cells 75*a, b, c, d*, and *e* form a desired pocket according to a pocket profile 72 in a material 70. Definition of volume cells 75*a, b, c, d*, and *e* include selecting an appropriate abrasive fluid-jet milling profile (e.g. abrasive fluid-jet milling profile 66 FIG. 2). The application of the abrasive fluid-jet 78 according to the selected abrasive fluid-jet milling profile and integrating the effects of abrasive fluid-jet 78 will allow prediction of removing a volume of the material 70 corresponding to the volume cell 75*a, b, c, d*, and *e*.

Importantly, the volume cells 75*a, b, c, d*, and *e* are not selected or configured to merely pack the desired pocket profile 72, as doing so ignores the cumulative effects of overlap of the cells. Where adjacent volume cells 75*a, b, c, d*, and *e* overlap, the abrasive fluid-jet 78 will remove an amount of the material 70 well in excess the boundaries of the overlapping defined volume cells 75*a, b, c, d*, and *e* due to the cumulative affect of the action of the abrasive fluid-jet 78 within an overlapping region. As indicated above, the volume of the material 70 removed by the action of the abrasive fluid-jet 78 is a generally linear function.

The computer 3 (FIG. 1*a*) calculates a series of volume cells 75*a, b, c, d, e* to overlay on the desired pocket cross-section profile 72. Each volume cell 75*a, b, c, d, e* represents the action of the abrasive fluid-jet 78 on the material 70. For each volume cell, the computer orients the abrasive fluid-jet 78 by determining an origin point and an orientation angle a, the orientation angle a being the offset of the axis 87 of the abrasive fluid-jet 78 from the normal 88 to the surface of the workpiece. The computer 3 (FIG. 1*a*) calculates the volume cells 75*a, b, c, d, e* based upon the selection of a suitable profile 66 (FIG. 2) and determination of suitable origin points, orientation angles a, and exposure times to evacuate material from a calculated volume cell 75*a, b, c, d, e* in order to suitably form a pocket of the desired pocket cross-section profile 72.

While not necessary for the operation of the invention, the abrasive fluid-jet is optionally equipped with a depth transducer 81 that sends a sensing emission or beam 84 into the volume cell 75*b* to sense the progress. Some of the transducers that have proven useful for this sensing are ultrasonic transducers or laser measurement sensors, though such sensors as touch sensors will also work. These transducers allow feedback loops for monitoring the progress of the evacuation and comparing the results with anticipated results for refinement of the calculations associated with each volume cell 75*a, b, c, d, e*.

Referring to FIGS. 3*a* and 3*b*, after suitably selecting the volume cells 75*a, b, c, d, e* for removal, the computer 3 (FIG. 1*a*) sends an instruction to the driver 5 (FIG. 1*a*) to suitably position the abrasive fluid-jet 78 at the origin point, and oriented at the angle a, with the suitably pressure, abrasive mix, orifice diameter and offset, and mixing tube length to begin milling. The abrasive fluid-jet 78 will continue to evacuate the material in the volume cell 75*a* according to the calculated exposure time. In the presently preferred embodiment, the transducer 81 continues to send out the sensing beam 84 to monitor progress and compare it to the calculated results to refine the calculated exposure time solution. At a time when suitable material has been removed, the abrasive fluid-jet 78 will re-orient at the origin point selected for the next volume cell 75*b*.

Referring to FIGS. 3*a*, 3*b*, and 3*c*, the abrasive fluid-jet 78 removes a volume of the material 70 corresponding to the next volume cell 75*b*. The additive nature of the material removal is shown as the actual material removed exceeds the outline of the volume cell 75*b*.

Referring to FIGS. 3*a* through 3*f*, the abrasive fluid-jet 78 removes each volume cell 75*c, d, e* in its turn. Throughout the removal of material, the presently preferred embodiment includes monitoring of the progress by means of the measurement transducer 81 and the measurement sensing beam 84. The additive effects of the abrasive fluid-jet 78 allow for complete removal of the material within the desired pocket profile 72.

The nature of the abrasive fluid-jet is such that the removal of discrete volume cells as distinct operations is not required nor is it practical. Pressurizing and depressurizing an abrasive fluid-jet 78 is not an ideally stepped function having an infinite slope in the transition from one pressure to another. Generally, to achieve pressures in the operative range of between 10 and 100 or more kpsi includes a ramping up to and down from operative pressures. While transitions from one operating pressure to another can be accommodated by the inventive method, in the presently preferred embodiment, volume cells are grouped to minimize the pressure transitions. It has proven advantageous rather than to turn the abrasive fluid-jet 78 on and off, to, instead, suitably select a path for volume cell 75*a, b, c, d, e* removal and allow continuous operation of the abrasive fluid-jet 78.

Referring to FIG. 4, an exemplary path is constructed to remove material from a portion of the desired pocket profile 72. As used herein, path describes movement of the abrasive fluid-jet relative to the workpiece regardless of whether the relative movement is achieved by movement of either the abrasive fluid-jet or the workpiece or both.

Once, the computer 3 (FIG. 1*a*) has suitably packed the desired pocket profile 72 with calculated volume cells 75*a* through *d*, 76*a* through *d*, and 77*a* through *d*. The computer 3 (FIG. 1*a*) has also calculated an advantageous path 90 including path segments 90*a* through *e*. On the path 90, the movement of the abrasive fluid-jet 78 is selected to include exposure times on the segments 90*a*, 90*c*, and 90*e* that overlay origin points of corresponding volume cells 77*c*, 77*d* and 76*d* respectively. Additionally, transit segments 90*b* and 90*d* are defined to allow rapid transition from one origin point and orientation to the next origin point and orientation. A velocity of the abrasive fluid-jet 78 in transiting across the transit segments 90*b* and 90*d* is selected to be a short as is necessary to orient the abrasive fluid-jet 78 to the next origin point and orientation. A longer path 90 will advantageously remove all material in a desired pocket profile 72 according to the placement of the volume cells throughout the profile 72.

Referring to FIG. 5*a*, the above-described method is not limited to planar objects but rather may be used to mill any workpiece of the material 70 whose movement may be indexed appropriately for CNC movement. For instance, a pocket 82 of a first depth 82*a* and a second depth 82*b* can be configured on the surface of a cylindrical workpiece. Because of the versatility of the CNC machinery, a five-axis CNC machine can be instructed in movement to maintain an orientation to the surface of the cylinder. In another presently preferred embodiment, rather than calculating with reference to a y-movement, the CNC machinery will rotate the cylinder about its axis in indexed units.

Referring to FIG. 5*b*, advantageously, when used on a planar surface, can differentially mill individual pockets 82 into a pocket of a first depth 82*a* and a pocket of a second depth 82*b*. Referring to FIG. 5*c*, the method can mill a pocket 82, differentiating from a pocket of a first depth 82*a* to a pocket of similar depth but of a distinct width 82*c*. The versatility of the inventive milling method allows any combination of these pockets to the limit of the ability of the computer 3 (FIG. 1*a*) to pack the desired pocket profile 72 (FIG. 4) with volume cells 75*a, b, c, d, e* (FIG. 4).

Referring to FIG. 5*d*, the complexity of the pocket 82*a* is not limited to simple curves but because of advantageous selection of a path 90, a very complex pocket is readily formed.

Referring to FIGS. 5*e* and 5*f*, as indicated above, the inventive method is not confined to strictly planar forms. With a suitably configured CNC machine 2 (FIG. 1*a*), pocket profiles that had previously been formable only by casting or drawing, can suitably be milled into a face of a workpiece of suitable material 70.

Additionally, nothing in the inventive method prevents the use of a submerging bath or vacuum shroud to contain noise, overspray and blowback. Referring to FIG. 6*a*, without any containment measures, milling by the inventive method 10 causes blowback 92 as the abrasive fluid-jet is reflected into the ambient atmosphere.

Referring to FIGS. 6*a*, and 6*b*, the workpiece is submerged in a bath to operably cause blowback 92 to be coalesced with the submerging bath passing the kinetic energy of the abrasive fluid-jet to the bath as the fluid reflects from the workpiece to form a flow of the bath fluid 95 rather than a blowback 92.

Referring to FIG. 6*c*, an alternate means of containing blowback is a vacuum shroud that draws the blowback 92 away from the ambient atmosphere to be conducted away there to lose the kinetic energy and to be processed to reclaim such abrasive as may be available.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The invention claimed is:

1. A method for using an abrasive fluid-jet to mill a pocket in a solid workpiece without use of a mask and without cutting fully through the workpiece by abrading material from the workpiece, the method comprising:

defining a path of the abrasive fluid-jet configured to mill the pocket in the solid workpiece having a shape and a depth less than the thickness of the workpiece, the path comprising a plurality of volume cells of varying profile to form the pocket, the path defined by a number of path parameters, the path parameters including a translation velocity, a fluid pressure, and an abrasive fluid-jet position and orientation relative to a surface of the workpiece, with values of the path parameters defined for different locations along the path such that the abrasive fluid-jet mills the pocket with the shape and depth without cutting fully through the workpiece, wherein defining a path further includes determining an exposure time necessary to remove the material in each volume cell; and generating a command set configured to drive a computer numerical control manipulator system according to the values of the path parameters of the defined path.

2. The method of claim 1, wherein defining a path includes abrading the workpiece using the abrasive fluid-jet according to a selected set of values for the path parameters in order to produce an abrasive fluid-jet milling pattern, the path parameters further including:

an abrasive flow rate;

a mixing tube length;

a mixing tube diameter; and a mixing tube alignment with the abrasive fluid-jet.

3. The method of claim 2, wherein defining the path includes compiling a catalog including at least one abrasive fluid-jet milling pattern, the abrasive fluid-jet milling pattern being stored in association with the selected set of values for the parameters.

4. The method of claim 3, wherein defining the path further includes selecting the abrasive fluid-jet milling pattern from the catalog of at least one abrasive fluid-jet milling patterns for removing the material.

5. The method of claim 3, wherein defining the path further includes defining the pocket as a set of adjacent volume cells, the volume cells determined according to the abrasive fluid-jet milling pattern and a volume cell origin point corresponding to each volume cell.

6. A method for using an abrasive fluid-jet to mill a pocket in a solid workpiece without use of a mask and without cutting fully through the workpiece by abrading material from the workpiece, the method comprising:

defining a path of the abrasive fluid-jet configured to mill the pocket in the solid workpiece having a shape and a depth less than the thickness of the workpiece, the path comprising a plurality of volume cells of varying profile to form the pocket, the path defined by a number of path parameters, the path parameters including a translation velocity, a fluid pressure, and an abrasive fluid-jet position and orientation relative to a surface of the workpiece with values of the path parameters defined for different locations along the path such that the abrasive fluid-jet mills the pocket with the shape and depth without cutting fully through the workpiece, wherein defining a path further includes:

abrading the workpiece using the abrasive fluid-jet according to a selected set of values for the path parameters in order to produce an abrasive fluid-jet milling pattern, the path parameters further including: an abrasive flow rate; a mixing tube length; a mixing tube diameter; and a mixing tube alignment with the abrasive fluid-jet;

compiling a catalog including at least one abrasive fluid-jet milling pattern, the abrasive fluid-jet milling pattern being stored in association with the selected set of values for the path parameters;

defining the pocket as a set of adjacent volume cells, the volume cells determined according to the abrasive fluid-jet milling pattern and a volume cell origin point corresponding to each volume cell; and determining an exposure time necessary to remove the material in each volume cell; and generating a command set configured to drive a computer numerical control manipulator system according to the values of the path parameters of the defined path.

7. The method of claim 6, wherein defining the path further includes ordering a set of the volume cell origin points to generate an ordered volume cell origin set wherein each element is a volume cell origin point and corresponds to one volume cell and includes the origin point, the abrasive fluid-jet milling volume cell, the abrasive fluid-jet orientation, and the exposure time.

8. The method of claim 7, wherein ordering the set includes:

ordering the set first according to an x-coordinate in each of the volume cell origin points, the x-coordinate corresponding to a location on a first axis in a plane; and ordering volume cell origin points with the same x-coordinate according to a y-coordinate in each of the volume cell origin points, the y-coordinate corresponding to a location on a second axis in the plane perpendicular to the first axis.

9. The method of claim 7, wherein ordering the set includes:

ordering the set first according to an y-coordinate in each of the volume cell origin points; and ordering volume cell origin points with the same y-coordinate according to a x-coordinate in each of the volume cell origin points, wherein the x-coordinate corresponds to a location on a first axis in a plane and the y-coordinate corresponds to a location on a second axis in the plane perpendicular to the first axis.

10. The method of claim 7, wherein ordering the set includes sorting volume cell origin points such that in the ordered set between any first volume cell origin point and any consecutive second volume cell origin point there is an absolute distance and the volume cell origin points are ordered to minimize the magnitude of the greatest absolute distance between every first volume cell and second volume cell.

11. The method of claim 7, wherein defining the path includes selecting a path including each volume cell origin point according to the ordered set.

12. The method of claim 11, wherein defining the path includes segmenting the path into an ordered segment set, the ordered segment set including a milling segment for each volume cell origin point.

13. The method of claim 12, wherein the defining the path includes selecting a translational velocity for each segment, the translational velocity being selected to allow translation through the milling segment in an interval equal to the exposure time corresponding to each volume cell origin point.

14. The method of claim 13, wherein the ordered segment set includes transition segments, the transition segments situated between milling segments and configured to allow completion of movement from a first volume cell origin point to a second volume cell origin point and a change in abrasive fluid-jet orientation from the orientation of the first volume cell origin point to the second volume cell origin point.

15. The method of claim 14, wherein a translational velocity is selected for each transition segment, the translational velocity being selection to enable movement from the first volume cell origin to the second volume cell origin and the change in abrasive fluid-jet orientation in the minimum amount of time.

16. The method of claim 1, wherein defining the path further includes defining the pocket as a set of adjacent volume cells, the volume cells determined according to the abrasive fluid-jet milling pattern and a volume cell origin point corresponding to each volume cell, and ordering a set of the volume cell origin points to generate an ordered volume cell origin set wherein each element is a volume cell origin point and corresponds to one volume cell and includes the origin point, the abrasive fluid-jet milling volume cell, the abrasive fluid-jet orientation, and the exposure time.

17. The method of claim 16, wherein ordering the set includes:

ordering the set first according to an x-coordinate in each of the volume cell origin points; and ordering volume cell origin points with the same x-coordinate according to a y-coordinate in each of the volume cell origin points.

18. The method of claim 16, wherein ordering the set includes:

ordering the set first according to an y-coordinate in each of the volume cell origin points; and ordering volume cell origin points with the same y-coordinate according to a x-coordinate in each of the volume cell origin points.

19. The method of claim 16, wherein ordering the set includes sorting volume cell origin points such that in the ordered set between any first volume cell origin point and any consecutive second volume cell origin point there is an absolute distance and the volume cell origin points are ordered to minimize the magnitude of the greatest absolute distance between every first volume cell and second volume cell.

20. The method of claim 16, wherein defining the path includes selecting a path including each volume cell origin point according to the ordered set.

21. The method of claim 20, wherein defining the path includes segmenting the path into an ordered segment set, the ordered segment set including a milling segment for each volume cell origin point.

22. The method of claim 21, wherein the defining the path includes selecting a translational velocity for each segment, the translational velocity being selected to allow translation through the milling segment in an interval equal to the exposure time corresponding to each volume cell origin point.

23. The method of claim 22, wherein the ordered segment set includes transition segments, the transition segments situated between milling segments and configured to allow completion of movement from a first volume cell origin point to a second volume cell origin point and a change in abrasive fluid-jet orientation from the orientation of the first volume cell origin point to the second volume cell origin point.

24. The method of claim 23, wherein a translational velocity is selected for each transition segment, the translational velocity being selection to enable movement from the first volume cell origin to the second volume cell origin and the change in abrasive fluid-jet orientation in the minimum amount of time.

* * * * *